US006655536B2

(12) United States Patent
Jo et al.

(10) Patent No.: US 6,655,536 B2
(45) Date of Patent: Dec. 2, 2003

(54) MERCHANDISE DISPLAY DEVICE

(76) Inventors: Merit Jo, 2550 Via Tejon, Suite 2D, Palos Verdes, CA (US) 90274; Merit William, 2550 Via Tejon, Suite 2D, Palos Verdes, CA (US) 90274

( * ) Notice: Subject to any disclaimer, the term of this patent is extended or adjusted under 35 U.S.C. 154(b) by 0 days.

(21) Appl. No.: 10/061,000

(22) Filed: Jan. 31, 2002

(65) Prior Publication Data

US 2003/0141265 A1 Jul. 31, 2003

(51) Int. Cl.[7] ..... A47F 1/04
(52) U.S. Cl. ..... 211/59.3; 211/184; 312/71
(58) Field of Search ..... 211/59.3, 59.2, 211/184; 312/71

(56) References Cited

U.S. PATENT DOCUMENTS

| | | | | | |
|---|---|---|---|---|---|
| 4,588,093 | A | | 5/1986 | Field | |
| 5,110,192 | A | * | 5/1992 | Lauterbach | 211/59.3 |
| 5,111,942 | A | * | 5/1992 | Bernardin | 211/59.3 |
| 5,542,552 | A | | 8/1996 | Yablans et al. | |
| 5,562,217 | A | | 10/1996 | Salveson et al. | |
| 5,613,621 | A | | 3/1997 | Gervasi | |
| 5,634,564 | A | | 6/1997 | Spamer et al. | |
| 5,673,801 | A | | 10/1997 | Markson | |
| 5,730,320 | A | | 3/1998 | David | |
| 5,839,588 | A | | 11/1998 | Hawkinson | |
| 5,855,283 | A | | 1/1999 | Johnson | |
| 5,878,895 | A | | 3/1999 | Springs | |
| 5,906,283 | A | | 5/1999 | Kump et al. | |
| 6,129,218 | A | * | 10/2000 | Henry et al. | 211/59.3 |
| 6,227,385 | B1 | * | 5/2001 | Nickerson | 211/59.3 |
| 6,401,942 | B1 | * | 6/2002 | Eckert | 211/59.3 |
| 6,409,028 | B2 | * | 6/2002 | Nickerson | 211/59.3 |
| 6,523,703 | B1 | * | 2/2003 | Robertson | 211/59.3 |
| 2002/0170866 | A1 | * | 11/2002 | Johnson et al. | 211/59.3 |

* cited by examiner

*Primary Examiner*—Robert W. Gibson, Jr.
*Assistant Examiner*—Erica B. Harris
(74) *Attorney, Agent, or Firm*—Edward A. Sokolski

(57) ABSTRACT

A device for displaying merchandise on a store shelf provides for arranging articles in rows with a pusher device for pushing the remaining articles forward on the shelf as each article is removed. A coiled spring operates to drive the pusher device for each row, the spring extending along a side rail having a hollow center in which the spring rides, the rail thus acting as a shield for the spring and preventing hand contact therewith which might cause injury.

12 Claims, 2 Drawing Sheets

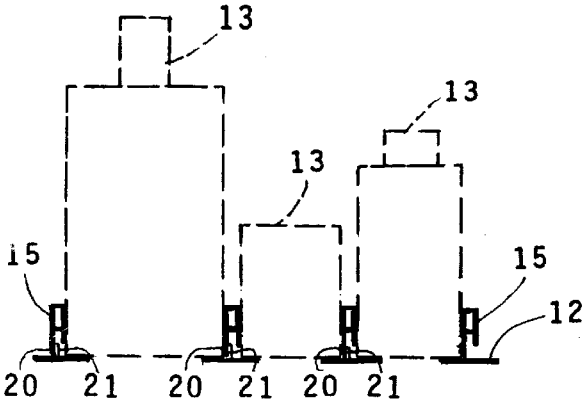
FIG. 5
FIG. 6
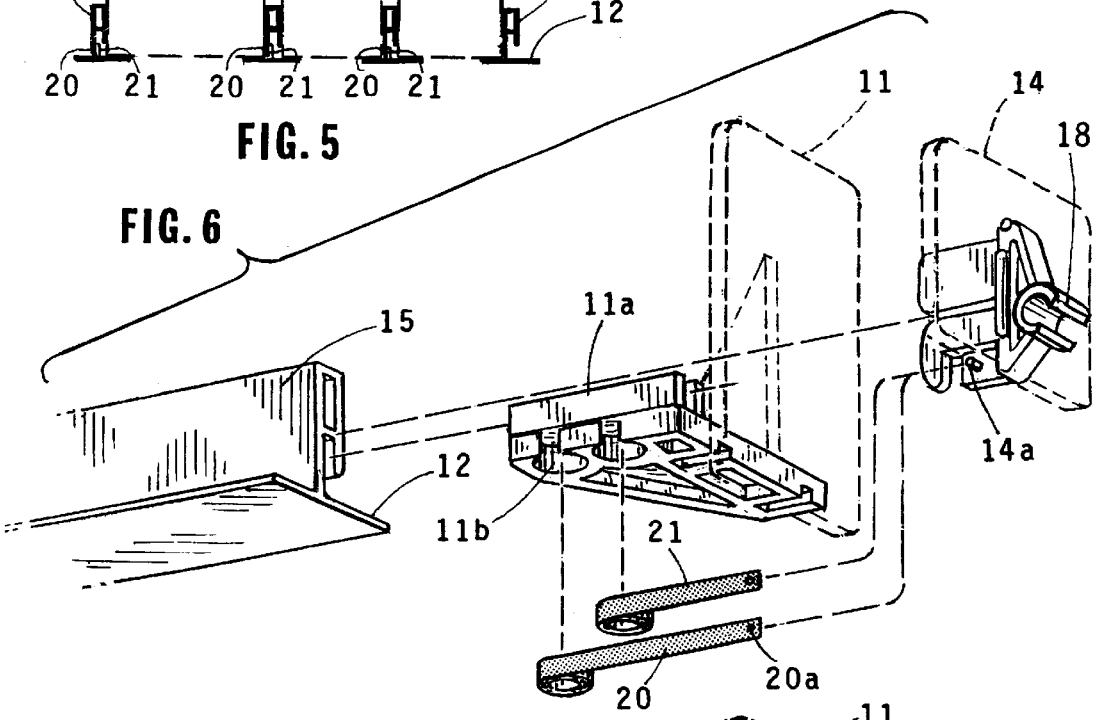
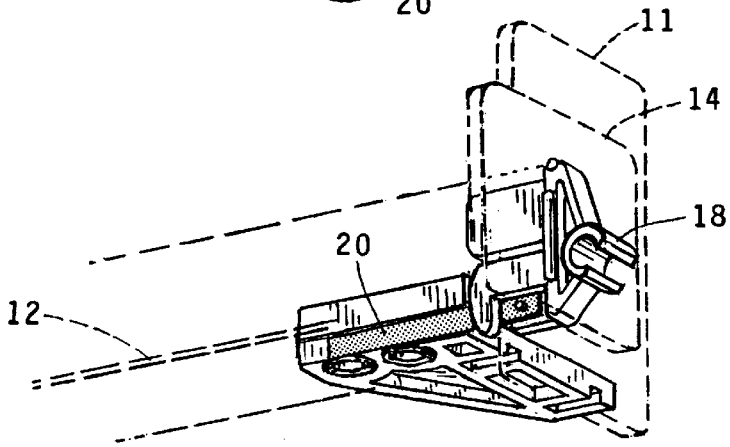
FIG. 7

MERCHANDISE DISPLAY DEVICE

BACKGROUND OF THE INVENTION

1. Field of the Invention

This invention relates to store merchandise shelves and more particularly to a system for displaying merchandise in rows on store shelves having a pusher for moving the remaining articles forward as each article is removed.

2. Description of the Related Art

In displaying merchandise on a store shelf, there generally are a relatively large number of articles for each item being displayed. With the articles arranged in a row, as each article is withdrawn from the shelf, the remaining articles appear further back on the shelf, lessening the effectiveness of the display and making it more difficult for the customer to find the desired article.

To remedy this situation pusher devices have been devised in the prior art to automatically push the row of articles forward so that when the front article is removed, the next article in line will be pushed forward to occupy the front position. Devices of this type are described in U.S. Pat. No. 4,588,093 issued May 13, 1986 to Field and U.S. Pat. No. 5,634,564 issued Jun. 3, 1997 to Spamer, et al. Both of these devices employ spring mechanisms to urge the row of articles towards the front of the shelf. A drawback of these prior art devices is that the spring mechanisms are exposed making them vulnerable to damage. Further, exposed spring mechanisms that have become damaged or dislodged as the result of excessive use or misuse are liable to interfere with the actions of the personnel loading the shelves and customers. In addition, such damaged spring mechanisms could have sharp edges which could cause injury to persons using the device.

SUMMARY OF THE INVENTION

The device of the present invention overcomes the shortcomings of the prior art by covering the spring mechanism used to drive the pusher with side runners. The device of the invention employs a coiled spring for driving the pusher, the spring being mounted on one end of a side runner which covers it, with the remote end of the spring being connected to the pusher plate. The spring extends longitudinally from its coiled portion to drive the pusher plate. Articles to be dispensed are mounted in rows along a base support with the rear most article being positioned against a stop plate. Such articles are driven towards the front of the shelf on which the base support is mounted by the pusher plate. The longitudinally extending portion of the spring is mounted within the hollow center of a side rail which acts as a shield for the spring. The spring is thus protected against damage and shielded against contact with operating personnel.

It is therefore an object of this invention to provide an improved merchandise display device;

It is a further object of this invention to provide a merchandise display device in which the spring assembly is less prone to damage than prior such devices.

It is still a further object of this invention to provide a merchandise display device in which the spring assembly is shielded so as to avoid damage to such assembly or injury to operating personnel.

Other objects of the invention will become apparent from the following description in conjunction with the accompanying drawings.

DESCRIPTION OF THE DRAWINGS

FIG. 5 is a cross sectional view taken along the plane indicated by 5—5 in FIG. 4;

FIG. 6 is a bottom perspective exploded view of the preferred embodiment; and FIG. 7 is a bottom perspective view of the front stopper plate and the pusher plate of the preferred embodiment.

DETAILED DESCRIPTION OF THE INVENTION

Figure 1:
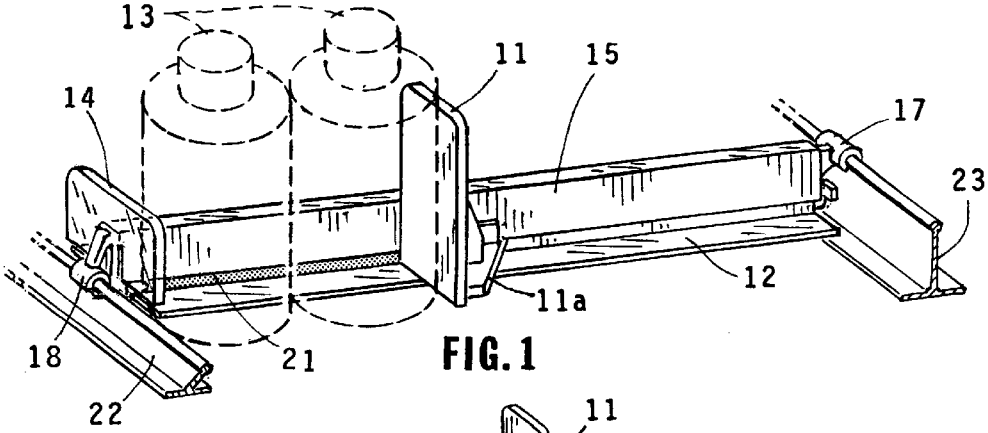
FIG. 1 is a top perspective view of a preferred embodiment of the invention.
Figure 2:
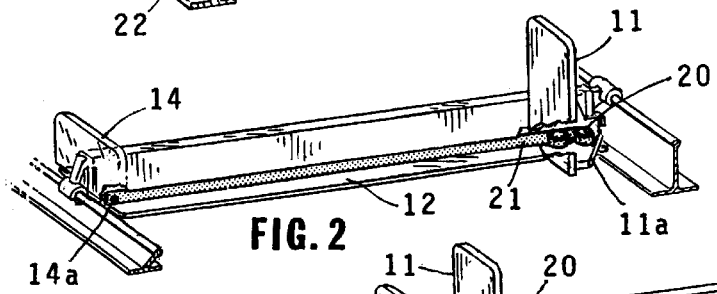
FIG. 2 is a top perspective view of the preferred embodiment showing the pusher plate in its fully extracted position.
Figure 3:
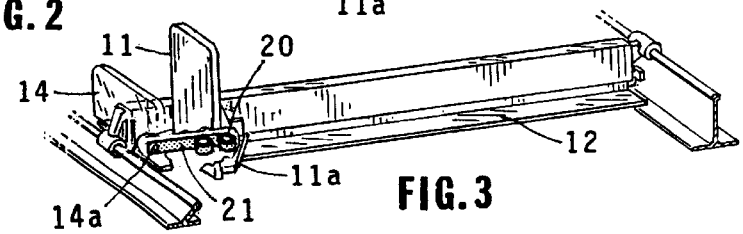
FIG. 3 is a top perspective view of the preferred embodiment showing the pusher plate in its contracted position directly opposite the stop plate.

Referring to the Figures, pusher plate 11 is slidably supported on base rail 12 and abuts against the rear most of articles 13 being displayed which are supported on the base rail. Stop plate 14 stops the forward motion of the articles. Side rail 15 has a hollow center in which rear and forward attachment members 17 and 18 are removably mounted. Rear attachment member 17 can be longitudinally adjusted, as shown in FIG. 2 to accommodate for the positioning of shelf supports which are supported on a shelf (not shown). Attachment members have attachment hooks on their ends which snap onto the rounded ends of supports 22 and 23 which are a attached to the shelf.

As shown in FIG. 6, the base support 11*a* of pusher plate 11 has a coil spring 20 mounted in a recess 11*b* formed in support 11. The end of he spring has an aperture 20*a* formed therein which is fitted onto pin 14*a* extending from the base portion of stop plate 14. In the alternative, the aperture at the end of the spring can be fitted into a slot. The top portion of the longitudinally extending portion of spring 20 rides in the bottom portion of the hollow center of side rail 15 which acts as a protective shield for the spring. A second spring 21 (see FIG. 6) may also be used in parallel with spring 20 to provide reinforcement and fail-safe operation. The spring (or springs) thus urge pusher plate 11 towards stop plate 14 retaining the articles 13 position and in abutment against each other with the forward article against the stop plate. The stop plate, in the alternative, can be in the form of a single plate which extends across the entire assembly. When the forward most article is removed, the next article in line is urged to a position against the stop plate.

Figure 4:
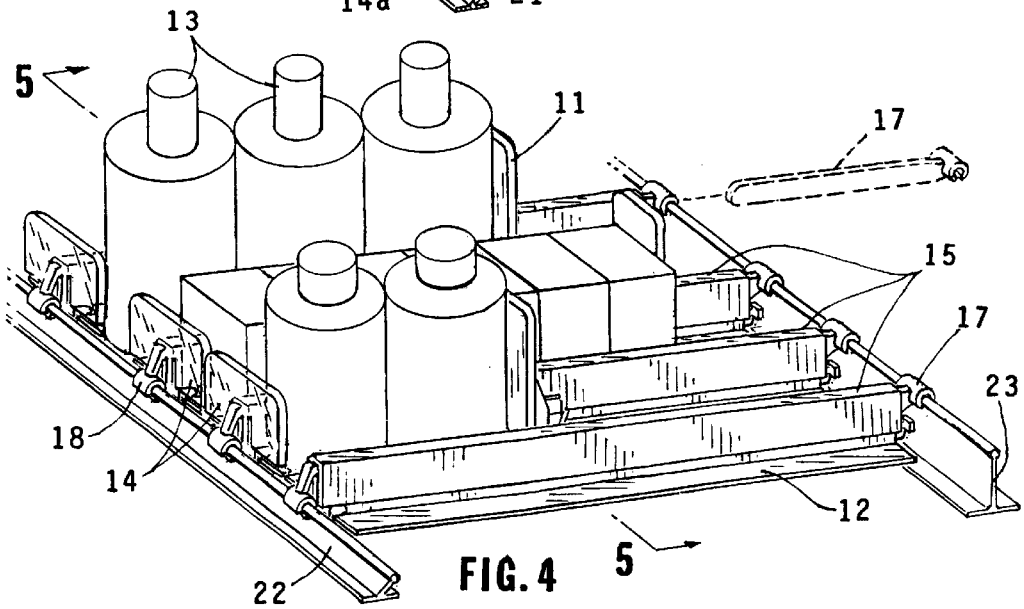
FIG. 4 is a top perspective view illustrating a plurality of the devices of the preferred embodiment of the invention arranged in adjoining rows with articles contained therein.

Referring to FIGS. 4 and 5, the use of the device of the invention with different width articles and with a plurality of rows of articles is illustrated. As can be seen, the width of the rows can be varied as may be desired to accommodate articles of various widths by varying the spacing between adjacent rows. Further, as many rows as may be required can be set up and readily changed should the situation so demand.

While the device has been described and illustrated in detail, this is intended by way of illustration and example only and not by way of limitation, the spirit and scope of the invention being limited only by the terms of the following claims.

We claim:

1. A plurality of articles and a device for storing said articles on a shelf and dispensing said articles comprising:

a base support member having forward and rear end portions;

said articles being mounted in a row on said base support member;

a stop member mounted in a row on the rear end portion of said base support member, the article in said row closest to the rear end portion of said base support member abutting against said stop member;

a pusher member slidably mounted on said base support member, said pusher member abutting against the article in said row closest to the forward end of said base support member, said pusher member having a base portion with a recess formed in a lower surface thereof;

a coil spring for driving said pusher member towards said stop member, said pusher member pushing the article against which it is abutting towards said stop member, one end of said spring being mounted in said recess formed in said base portion, the other end of said spring being attached to said stop member; and means for shielding said spring.

2. The device of claim 1 wherein said row of articles is substantially linear.

3. The device of claim 1 wherein said stop member and said pusher member are in the form of substantially flat plates.

4. The device of claim 1 wherein said means for shielding said spring comprises a hollow side rail running longitudinally along one side of said base support member, at least a portion of said spring riding in the hollow part of said side rail, thereby providing shielding for said spring.

5. The device of claim 1 and further including a second row of articles running substantially parallel to said first row, said second row being supported and driven in the same manner as said first row.

6. The device of claim 5 wherein said second row of articles has a different width said first row of articles.

7. The device of claim 1 wherein and further including support means on said shelf for removably supporting the opposite ends of said side rail.

8. A plurality of articles and a device for storing said articles on a shelf and dispensing said articles comprising:

a base support member having forward and rear end portions;

said articles being mounted in a row on said base support member;

a substantially flat stop member mounted in said row on the rear end portion of said base support member, the article in said row closest to the rear end portion of said base support member abutting against said stop member;

a substantially flat pusher member slidably mounted on said base support member, said pusher member abutting against the article in said row closest to the forward end of said base support member, said pusher member having a base portion supporting said pusher member on said base support member, said base member having a recess formed in a lower surface thereof;

a coil spring for driving said pusher member towards said stop member, one end of said coil spring being removably attached to said stop member, the other end portion of said spring being mounted in the recess formed in the base portion of said pusher member, a portion of said spring running longitudinally between said recess and said stop member; and a linear side rail having a hollow center, said side rail running longitudinally on said base member along one side of said row of articles, the longitudinally running portion of said spring member riding in the hollow center of said side rail.

9. The device of claim 8 and further including a second row of articles running substantially parallel to said first row of articles, said second row of articles being supported and driven in the same manner as said first row of articles.

10. The device of claim 9 wherein said second row of articles has a different width than said first row of articles.

11. The device of claim 8 and further including support means on said store shelf for removably supporting said side rail at the apposite ends thereof.

12. A plurality of articles and a device for storing said articles on a shelf and dispensing said articles comprising:

a base support member having forward and rearward portions, said articles being mounted in a row on said base support member, a stop member mounted in said row on the rear end portion of said base support member abutting against said stop member, a pusher member slidably mounted in said row on said base support member, said pusher member having a base portion which rides along the base support member, said base portion having a recess formed therein, said pusher member abutting against the article in said row closest to the forward end of said base support member, a coil spring for driving said pusher member towards said stop member, one end of said coil spring being attached to said stop member, the other end portion of said coil spring being coiled and mounted in the recess formed in the base support member, and a second coil spring running substantially parallel to the first coil spring, the base portion of said pusher member having a second recess formed therein, one end of said second coil spring being coiled and mounted in said second recess, the other end of said second coil spring being attached to said stop member.

* * * * *